US009987634B2

(12) United States Patent
Piramoon

(10) Patent No.: US 9,987,634 B2
(45) Date of Patent: Jun. 5, 2018

(54) CENTRIFUGE SAMPLE CONTAINER AND CLOSURE THEREFOR

(71) Applicant: Fiberlite Centrifuge, LLC, Santa Clara, CA (US)

(72) Inventor: Sina Piramoon, San Jose, CA (US)

(73) Assignee: Fiberlite Centrifuge, LLC, Santa Clara, CA (US)

( * ) Notice: Subject to any disclaimer, the term of this patent is extended or adjusted under 35 U.S.C. 154(b) by 0 days. days.

(21) Appl. No.: 14/558,912

(22) Filed: Dec. 3, 2014

(65) Prior Publication Data

US 2016/0158744 A1 Jun. 9, 2016

(51) Int. Cl.
*B01L 3/00* (2006.01)

(52) U.S. Cl.
CPC ..... *B01L 3/508* (2013.01); *B01L 3/5021* (2013.01); *B01L 2200/087* (2013.01); *B01L 2300/046* (2013.01); *B01L 2400/0409* (2013.01)

(58) Field of Classification Search
CPC ..... B01L 3/508; B01D 21/262; B01D 45/12; B01D 53/24; B01D 2215/029; B65D 53/00; B65D 39/007
USPC ..... 422/72, 548; 215/276
See application file for complete search history.

(56) References Cited

U.S. PATENT DOCUMENTS

| | | | | |
|---|---|---|---|---|
| 1,665,602 A | | 4/1928 | Netherland | |
| 2,078,743 A | | 4/1937 | Traum | |
| 2,307,390 A | | 1/1943 | Chew | |
| 2,549,225 A | | 4/1951 | Moy | |
| 3,366,320 A | | 1/1968 | Cho | |
| 3,391,597 A | | 7/1968 | Gropper | |
| 3,410,435 A | | 11/1968 | Kopczynski | |
| 3,434,615 A | * | 3/1969 | Barletta | B01L 3/5021 215/276 |
| 4,469,235 A | | 9/1984 | Parker | |
| 4,514,091 A | | 4/1985 | Kaspar et al. | |
| 4,915,255 A | | 4/1990 | Curtis | |
| 5,184,740 A | | 2/1993 | Mandrell, II et al. | |
| 5,344,380 A | | 9/1994 | Chern et al. | |
| D351,793 S | | 10/1994 | Stoller | |
| 5,431,305 A | * | 7/1995 | Kaminski | B65D 47/244 222/109 |

(Continued)

FOREIGN PATENT DOCUMENTS

| | | | |
|---|---|---|---|
| JP | 5876154 A | | 5/1983 |
| JP | S5876154 | * | 5/1983 |
| WO | 2009026436 A1 | | 2/2009 |

OTHER PUBLICATIONS

Thermo Fisher Scientific; Thermo Scientific Fiberlite Carbon Fiber Rotors, product brochure, copyright 2013; 16 pages.

(Continued)

*Primary Examiner* — Jill A Warden
*Assistant Examiner* — Jacqueline Brazin
(74) *Attorney, Agent, or Firm* — Wood Herron & Evans LLP

(57) ABSTRACT

A closure for attachment to a sample container for use in a centrifuge includes a top wall, an annular skirt wall depending from the top wall and defining a maximum outer diameter, and a handle extending from the top wall and including a central boss and at least two finger grips extending radially outward from the central boss. A respective free terminal end of each of the finger grips is located so as not to extend beyond the maximum outer diameter.

16 Claims, 7 Drawing Sheets

(56) References Cited

U.S. PATENT DOCUMENTS

| | | | | |
|---|---|---|---|---|
| D367,613 | S | 3/1996 | Weiler | |
| 5,533,644 | A | 7/1996 | Glen et al. | |
| 5,704,502 | A | 1/1998 | Greenfield | |
| 5,899,349 | A | 5/1999 | Moore | |
| 5,941,404 | A | 8/1999 | Charrette | |
| RE36,341 | E | 10/1999 | Howell | |
| 6,062,407 | A | 5/2000 | Moore | |
| 6,253,942 | B1 | 7/2001 | Elias | |
| 6,350,225 | B1 * | 2/2002 | Sheeran | B01L 3/5021 215/386 |
| 6,811,047 | B1 * | 11/2004 | Hicks | B65D 41/0421 215/305 |
| D511,457 | S | 11/2005 | Biesecker et al. | |
| 7,988,007 | B2 | 8/2011 | Baughman et al. | |
| 8,002,131 | B2 | 8/2011 | Karabin | |
| 8,105,556 | B2 | 1/2012 | Romanauskas et al. | |
| 8,215,508 | B2 * | 7/2012 | Baird | B01L 3/5021 215/276 |
| 8,616,394 | B2 | 12/2013 | Kim | |
| 8,668,098 | B2 | 3/2014 | Wand | |
| 9,272,278 | B2 | 3/2016 | Daub et al. | |
| 9,278,361 | B2 | 3/2016 | Holderle | |
| D777,342 | S | 1/2017 | Piramoon | |
| 2007/0228001 | A1 * | 10/2007 | Higgins | B65D 47/36 215/253 |
| 2008/0041869 | A1 * | 2/2008 | Backaert | B65D 39/025 220/804 |
| 2010/0308006 | A1 | 12/2010 | Walker-Smith | |
| 2011/0220607 | A1 | 9/2011 | Mukunoki | |
| 2011/0319247 | A1 * | 12/2011 | Kitazawa | B01L 3/5021 494/16 |
| 2013/0316889 | A1 | 11/2013 | Asakura et al. | |
| 2016/0158745 | A1 | 6/2016 | Piramoon | |
| 2016/0310967 | A1 | 10/2016 | Henne et al. | |

OTHER PUBLICATIONS

United Kingdom Intellectual Property Office, Combined Search and Examination Report for Great Britain Patent Application No. GB1521187.3 dated May 25, 2016, 6 pages.

United States Patent and Trademark Office, Office Action, U.S. Appl. No. 14/936,196, dated Jan. 3, 2017 (28 pages).

United States Patent and Trademark Office, Final Office Action, U.S. Appl. No. 14/936,196, dated Aug. 10, 2017 (29 pages).

* cited by examiner

CENTRIFUGE SAMPLE CONTAINER AND CLOSURE THEREFOR

TECHNICAL FIELD

The present invention relates generally to containers and, more particularly, to sample containers and closures for use in a centrifuge.

BACKGROUND

Laboratory applications frequently require centrifugation to separate samples into various components having different densities. Each sample is placed inside of a sample container through a mouth of the container body, which is then securely sealed with a closure to ensure that the sample remains within the container during centrifugation. Known closures are configured to threadedly engage the sample container body, such that the closure may be rotated relative to the container body for attachment and removal. The assembled sample container is lowered into a cavity of a centrifuge rotor, which is then rotated by a centrifuge to achieve separation of the sample into its components.

Large-capacity sample containers, such as sample containers capable of holding at least 750 ml of sample, are often used in applications requiring centrifugation of large volumes of samples. Such a large-capacity container may be formed with a container body having a mouth formed with a large diameter. The closure for use with a large-capacity container thus may also be formed with a corresponding large diameter. However, a large-diameter closure often proves difficult to be adequately gripped by some users, particularly those having small hands, when rotating the closure for attachment and removal. Furthermore, the large-diameter closure may also prove difficult to be adequately gripped when supporting and moving the sample container in vertical directions, for example when lowering a sample container into, or lifting a sample container from, a centrifuge rotor.

Known closures for centrifuge sample containers, including large-capacity sample containers, fail to provide adequate assistive features for aiding a user when rotatably attaching and removing the closure, as well as when lifting or lowering the assembled container. Accordingly, there remains a need for improvement in the area of centrifuge sample containers.

SUMMARY

The present invention provides improvements to overcome shortcomings of known closures for centrifuge sample containers. While the invention will be described in connection with several embodiments, it will be understood that the invention is not limited to these embodiments. On the contrary, the invention includes all alternatives, modifications, and equivalents as may be included within the spirit and scope of the present invention.

In one embodiment, a closure for attachment to a sample container for use in a centrifuge includes a top wall, an annular skirt wall depending from the top wall and defining a maximum outer diameter, and a handle extending from the top wall and including a central boss and at least two finger grips extending radially outward from the central boss. A respective free terminal end of each of the finger grips is located so as not to extend beyond the maximum outer diameter.

In another embodiment, a sample container for use in a centrifuge includes a container body having an inner cavity and a mouth opening to the inner cavity, and a closure removably attachable to the container body for closing the mouth when the closure is attached to the container body. The closure includes a top wall, an annular skirt wall depending from the top wall and defining a maximum outer diameter, and a handle extending from the top wall and including a central boss and at least two finger grips extending radially outward from the central boss. A respective free terminal end of each of the finger grips is located so as not to extend beyond the maximum outer diameter.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
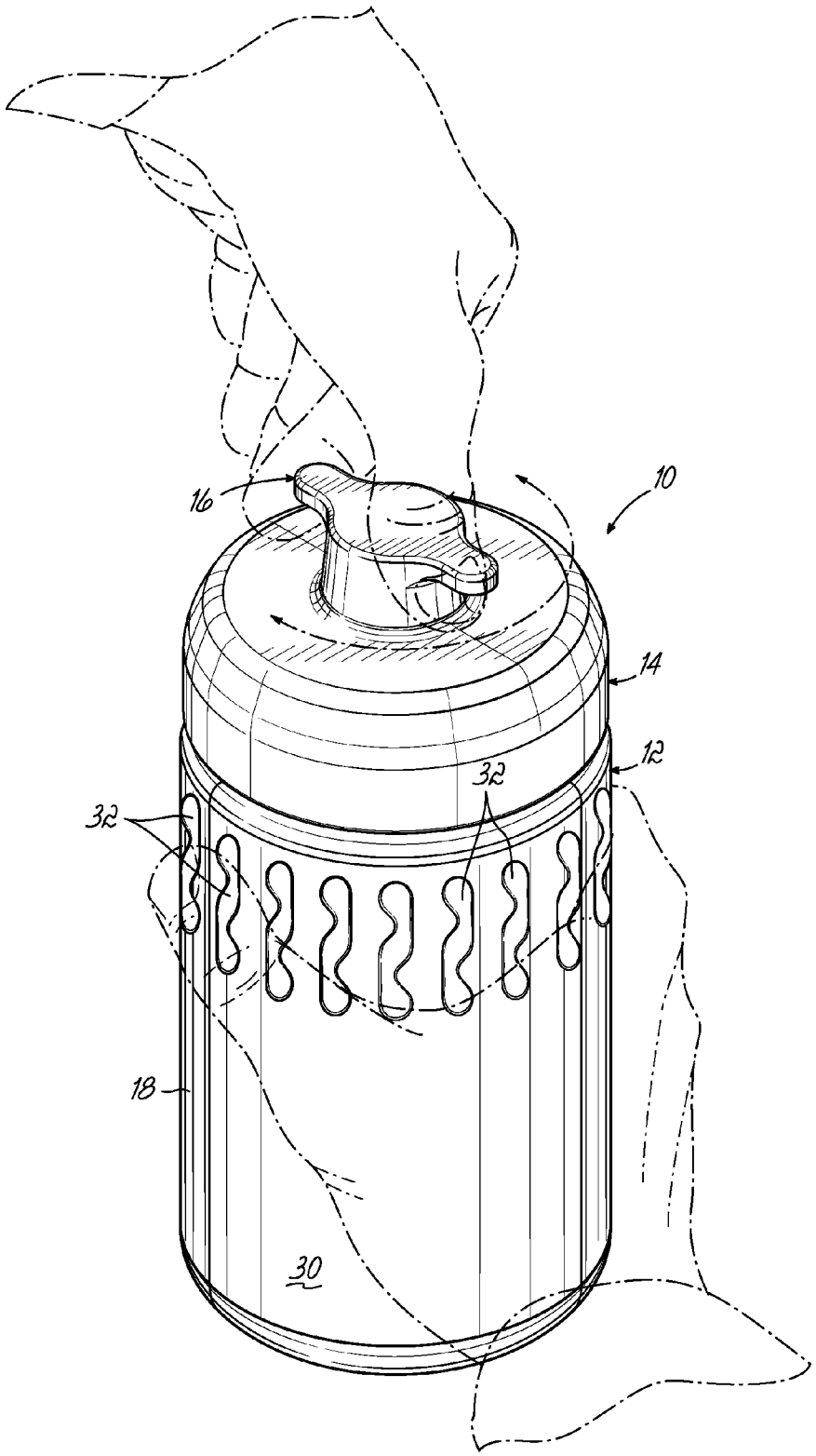
FIG. 1 is a perspective view of a centrifuge sample container including a closure according to one embodiment, showing rotation of the closure by a user.
Figure 1A:
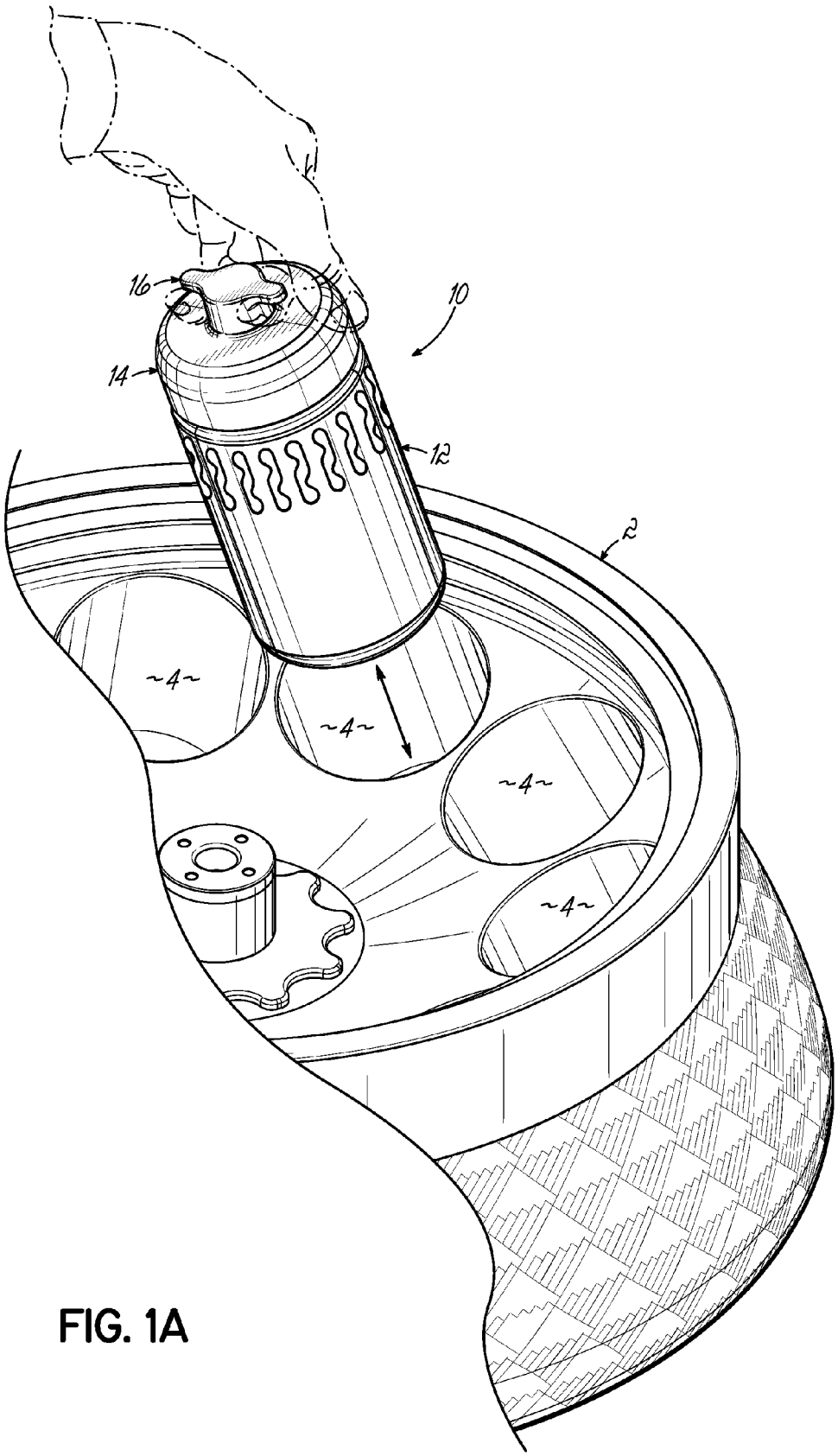
FIG. 1A is a perspective view of the centrifuge sample container of FIG. 1, showing lifting and lowering of the sample container relative to a centrifuge rotor.

FIGS. 1 and 1A show an exemplary embodiment of a centrifuge sample container 10 for use in a fixed angle centrifuge rotor 2 having a plurality of tubular cell-hole cavities 4. While not shown, it will be readily understood by those of ordinary skill in the art that the fixed angle centrifuge rotor 2 is configured to be mounted into a centrifuge and spun at a desired rotational rate during operation of the centrifuge. The sample container 10 can also be loaded into and spun by fixed angle centrifuge rotors of other configurations, swinging bucket type centrifuge rotors of various configurations, or centrifuge rotors of various other types and configurations.

The sample container 10, shown in the form of a centrifuge bottle, includes a container body 12 and a closure 14 removably attached to the container body 12. As shown, the closure 14 includes a handle 16 that is configured to be gripped by a hand of a user for rotating the closure 14 relative to the container body 12 for attachment to, or removal from, the container body 12. Additionally, as shown in FIG. 1A, the handle 16 enables the user to easily support the sample container 10 in a vertical direction for lifting, lowering, or carrying the container 10, for example during loading and unloading of a centrifuge rotor 2, or during transport of the sample container 10.

Referring to FIGS. 2-5, the container body 12 includes a body wall 18 defining an inner cavity 20, and a mouth 22 defining an opening 24 that communicates with the inner cavity 20. As shown in the illustrated embodiment, an upper end of the container body 12 may include a neck 26 and a rim 28 that defines the mouth 22. An outer surface 30 of the container body wall 18 may include one or more gripping features 32 configured to enhance a user's ability to grip the container body 12 during use, for example during attachment and removal of the closure 14. As shown, the container body 12 and closure 14 may be formed with substantially circular cross-sectional shapes. However, persons skilled in the art will appreciate that the container body 12 and the closure 14 may be formed with any suitable cross-sectional shape. Moreover, the container body 12 and the closure 14 may be formed of any material suitable for the desired centrifuge application, such as polycarbonate or high-density polyethylene, for example.

The container body 12 may be formed with any suitable dimensions so as to define an inner cavity 20 of any suitable volume. For example, the container body 12 may be formed with any suitable axial length, as indicated by the break-away lines 13 shown in FIG. 5. In one embodiment, the container body 12 may be sized such that the inner cavity 20 is configured to receive 750 ml or more of sample, such as 2,000 ml, by way of example. As described below, the features of the closure 14 may prove particularly advantageous for use in connection with large-capacity sample containers having large-diameter mouths and corresponding large-diameter closures, such as sample containers designed for receiving 1,000 ml or more of sample, although smaller-capacity sample containers having smaller-diameter closures are possible as well.

Figure 4:
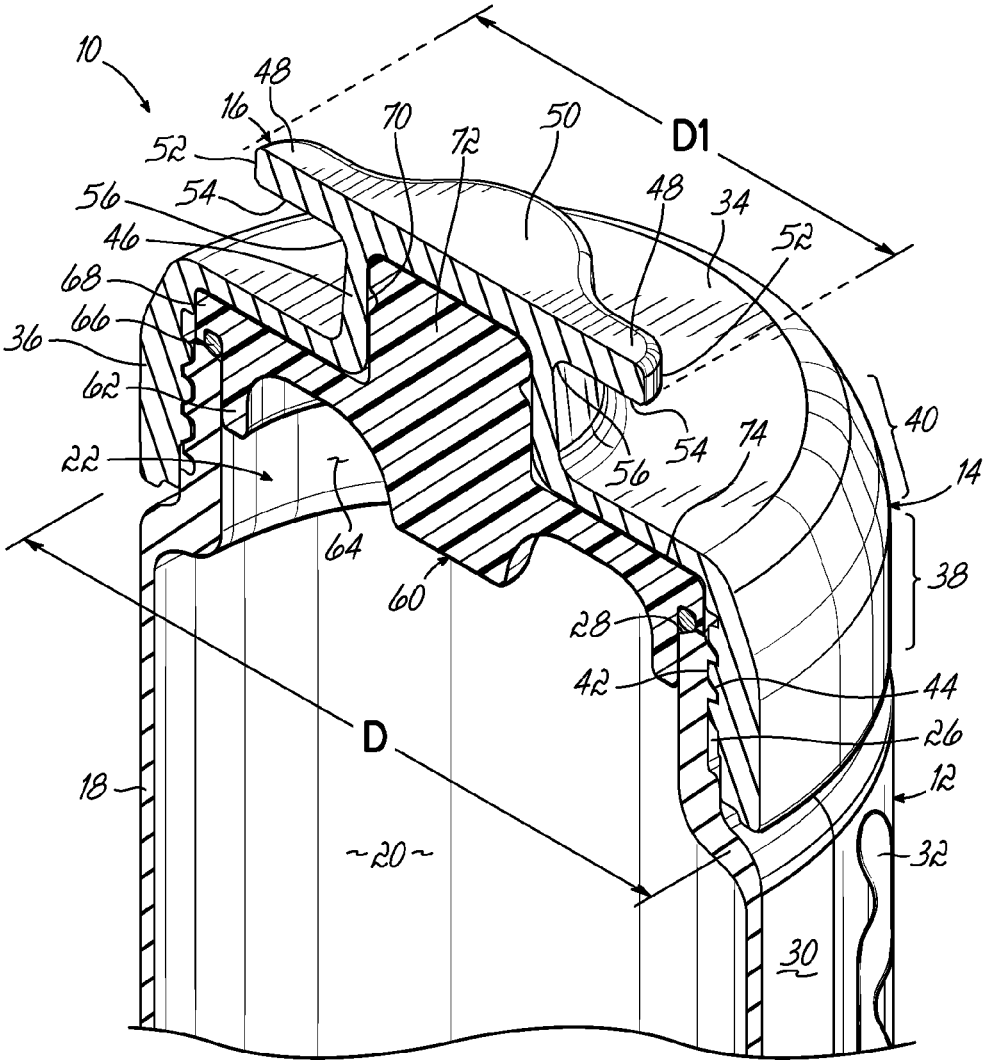
FIG. 4 is a perspective, cross-sectional view taken along line 4-4 of FIG. 2.
Figure 5:
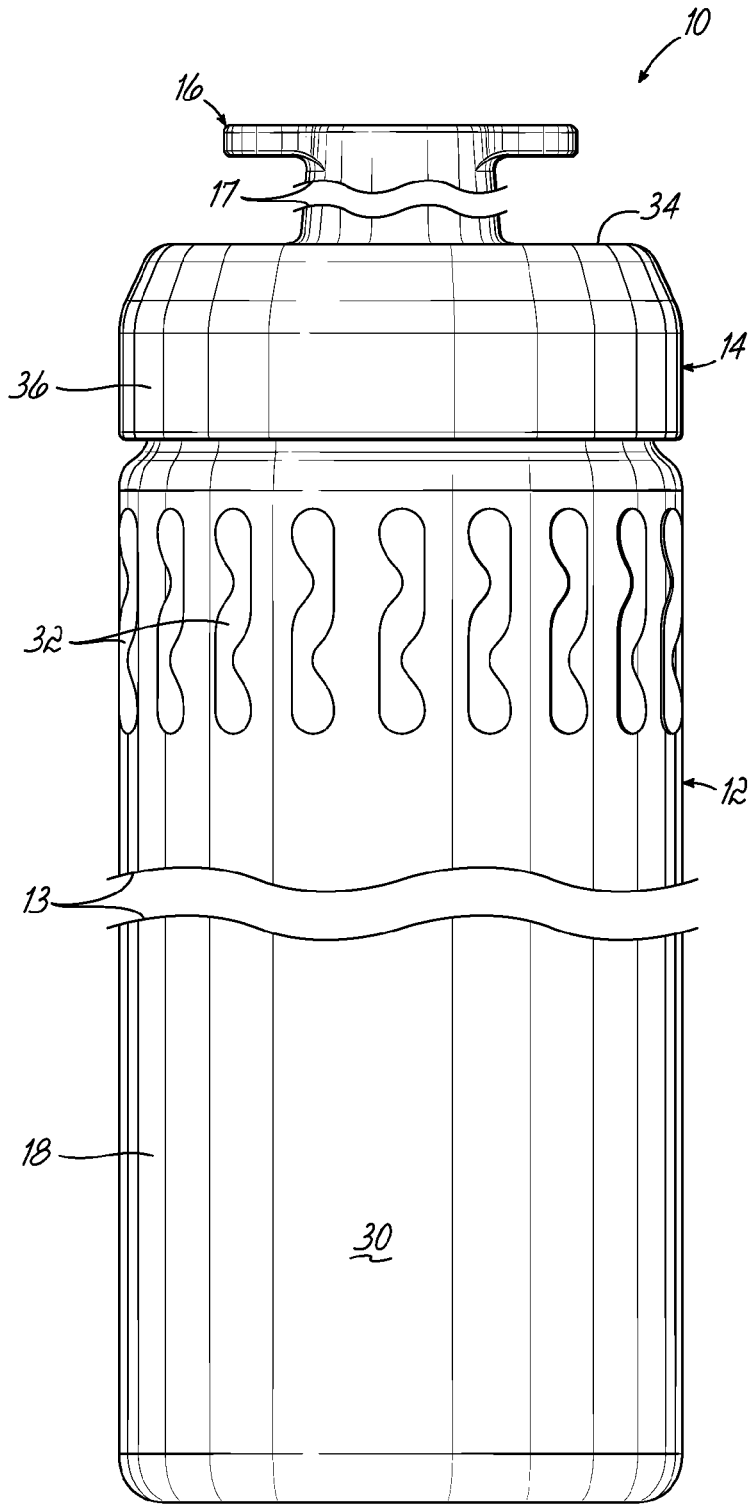
FIG. 5 is a front elevation view of a centrifuge sample container including a closure according to an alternative embodiment.

The closure 14 of the illustrated embodiment includes a top wall 34 and an annular skirt wall 36 connected to and depending downward from the top wall 34. The skirt wall 36 defines a maximum outer periphery of the closure 14, and a corresponding maximum outer diameter of the closure 14, indicated by D in FIG. 4. As shown, the skirt wall 36 may include a cylindrical portion 38 and a tapered portion 40. As shown in FIG. 4, a radially inner surface of the skirt wall 36 may include a first threaded portion 42 configured to threadedly engage a corresponding second threaded portion 44 provided on the neck 26 of the container body 12.

The handle 16 of the closure 14 extends axially outward from and is coupled to the top wall 34. In particular, the handle 16 includes a central boss 46 extending outwardly from the top wall 34 along an axial centerline of the closure 14, and a plurality of finger grips 48 extending radially outward from an upper portion 50 of the central boss 46. In one embodiment, as shown, the handle 16 may include two finger grips 48 that are diametrically opposed about the axial centerline of the closure 14, and that extend generally perpendicular to the axial centerline, and generally parallel to the top wall 34, of the closure 14.

The central boss 46 may be generally frustoconically shaped, or tapered, so as to define a generally circular cross-sectional shape that progressively decreases in diameter in a direction away from the top wall 34. In that regard, the central boss 46 may extend axially for any suitable axial length, as indicated by the break-away lines 17 shown in FIG. 5, and with any suitable taper angle relative to the top wall 34. Additionally, the central boss 46 may be formed integrally as one piece with the top wall 34 and the skirt wall 36, and each finger grip 48 may be formed integrally as one piece with the central boss 46.

Each finger grip 48 extends radially outward from the upper portion 50 of the central boss 46 toward a free terminal end 52, which may be substantially rounded. As shown in FIG. 4, the free terminal ends 52 of the finger grips 48 jointly define a maximum outer diameter D1 of the handle 16, which may be less than a maximum outer diameter D defined by the annular skirt wall 36, as described in greater detail below. In that regard, each finger grip 48 is formed with a radial length such that the respective free terminal end 52 does not extend beyond the maximum outer diameter D defined by the annular skirt wall 36. Additionally, each finger grip 48 is axially offset from the top wall 34 of the closure 14, such that an axial gap is defined between the top wall 34 and an underside 54 of each finger grip 48. Accordingly, and advantageously, particularly when the skirt wall 36 defines a maximum outer diameter D that is too large to be adequately gripped by a single hand of a user, the finger grips 48 of the handle 16 may be easily and securely gripped by a user for rotating the closure 14 (FIG. 1), and/or for lifting or lowering the assembled sample container 10 into or out of the rotor 2 (FIG. 1A).

In one embodiment, the maximum outer diameter D1 defined by the free terminal ends 52 of the finger grips 48 may be approximately 40-60% of the maximum outer diameter D defined by the annular skirt wall 36. In other embodiments, such as that described below in connection with FIG. 6, a closure may include finger grips that extend radially outward such that the free terminal ends of the finger grips define a maximum outer diameter D1 that is greater than 60%, but less than 100%, of the maximum outer diameter D, or equal to the maximum outer diameter D, defined by the annular skirt wall 36 of the closure. Additionally, the finger grips may extend radially outward for at least a minimum length that is sufficient to enable a user to grasp the finger grips with one or more fingers.

Figure 2:
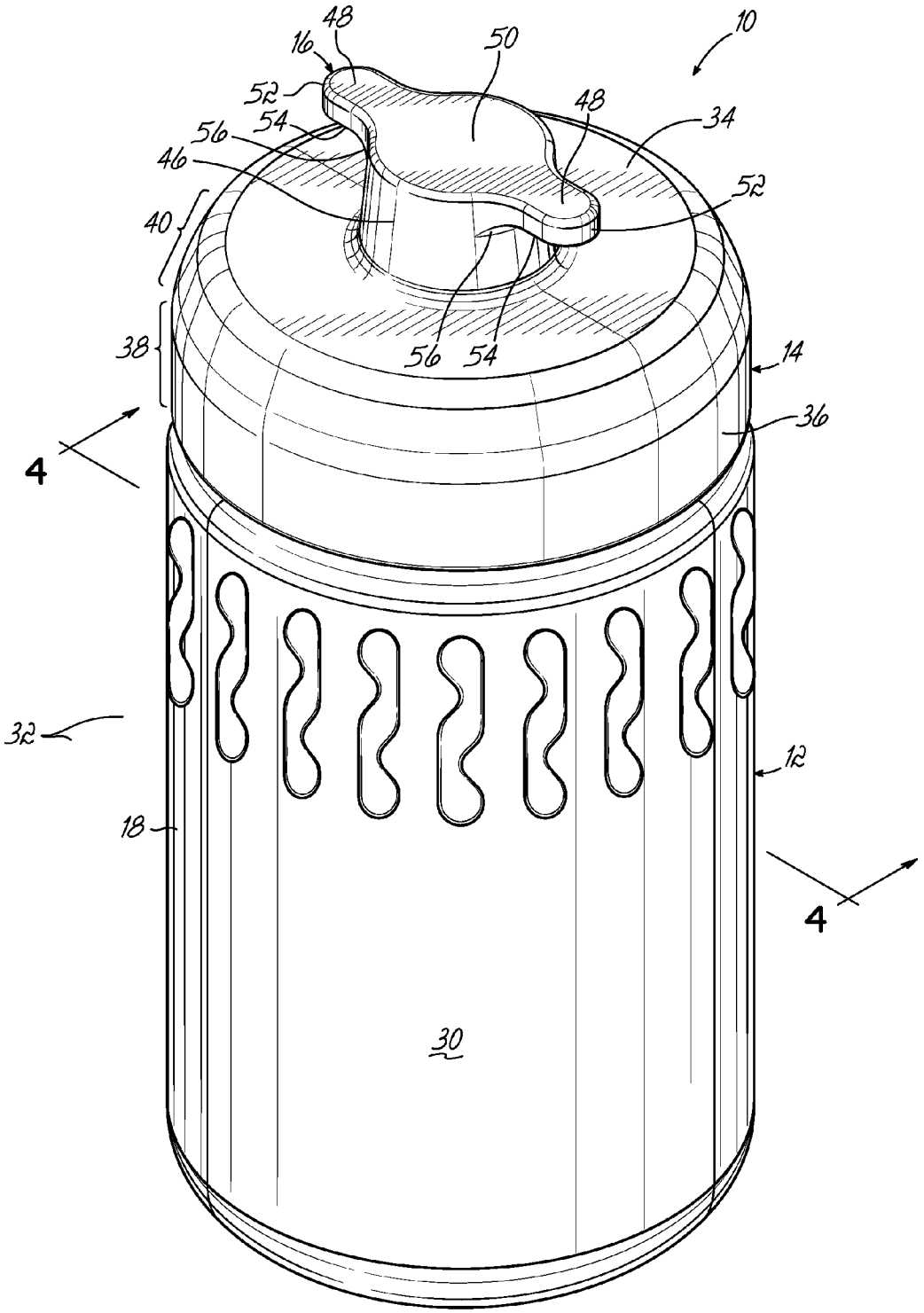
FIG. 2 is a perspective view of the centrifuge sample container of FIG. 1.
Figure 3:
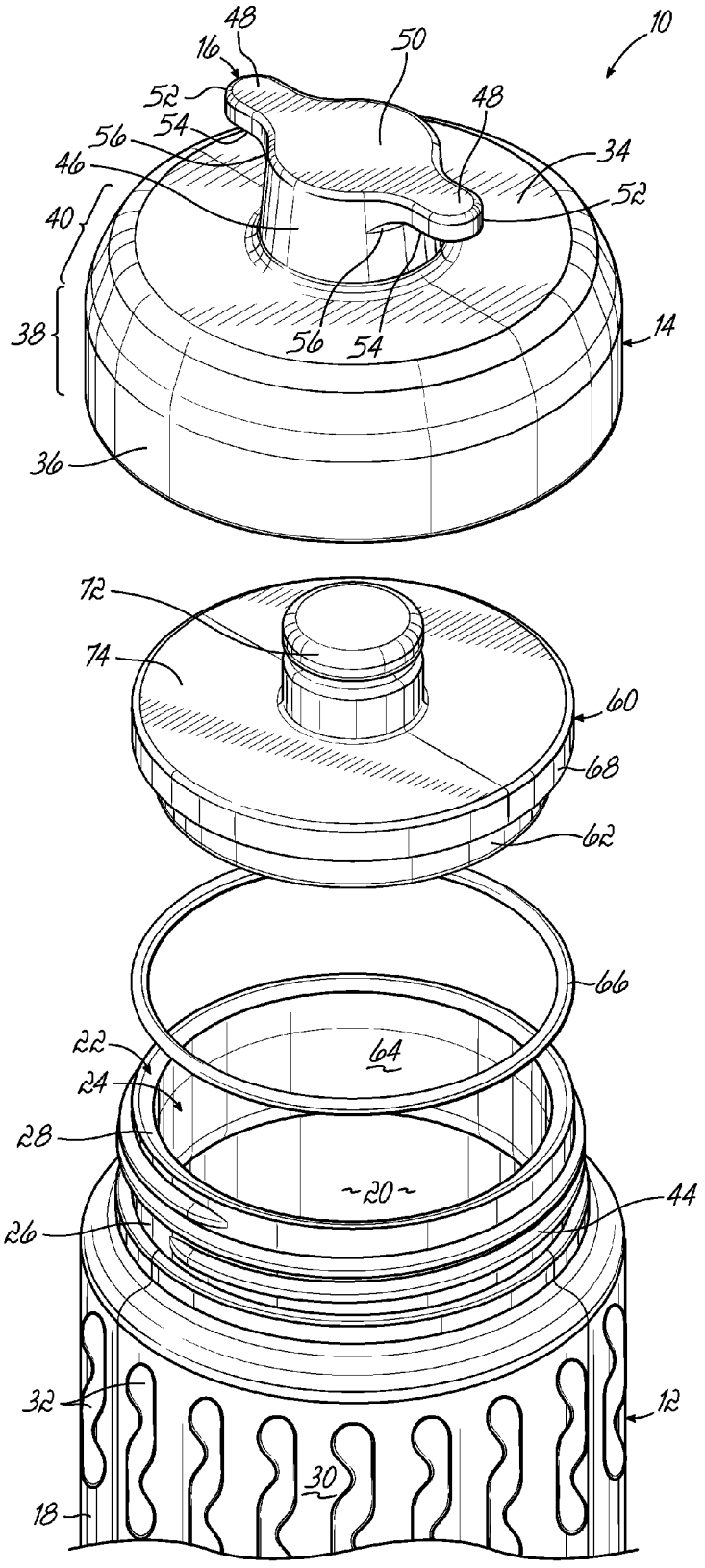
FIG. 3 is a perspective, disassembled view of the centrifuge sample container of FIG. 1.

As best shown in FIGS. 2 and 3, each finger grip 48 may further include a blended region 56 at a location where the finger grip 48 couples to the central boss 46. As shown, an axial thickness of the finger grip 48 at the blended region 56 may be greater than an axial thickness of the finger grip 48 near the free terminal end 52. Accordingly, the blended region 56 may provide the finger grip 48 with improved structural rigidity for withstanding axial and rotational forces exerted on the finger grip 48 during use, for example during rotation or lifting of the closure 14 by the handle 16.

The central boss 46 and finger grips 48 of the handle 16 in FIGS. 1-5 are shown arranged in a particular configuration and having particular shapes and relative dimensions in accordance with one embodiment of the invention. Persons skilled in the art will appreciate that the central boss 46 and finger grips 48 may be formed with various alternative shapes, relative dimensions, and configurations, such that a respective free terminal end of each finger grip is located so as not to extend beyond a maximum outer diameter D defined by the skirt wall 36. For example, in one alternative embodiment (not shown), a closure may include three or more radially extending finger grips 48 circumferentially spaced about the axial centerline of the closure 14 and having respective free terminal ends 52 that are located so as not to extend beyond the maximum outer diameter D defined by the skirt wall 36.

Figure 6:
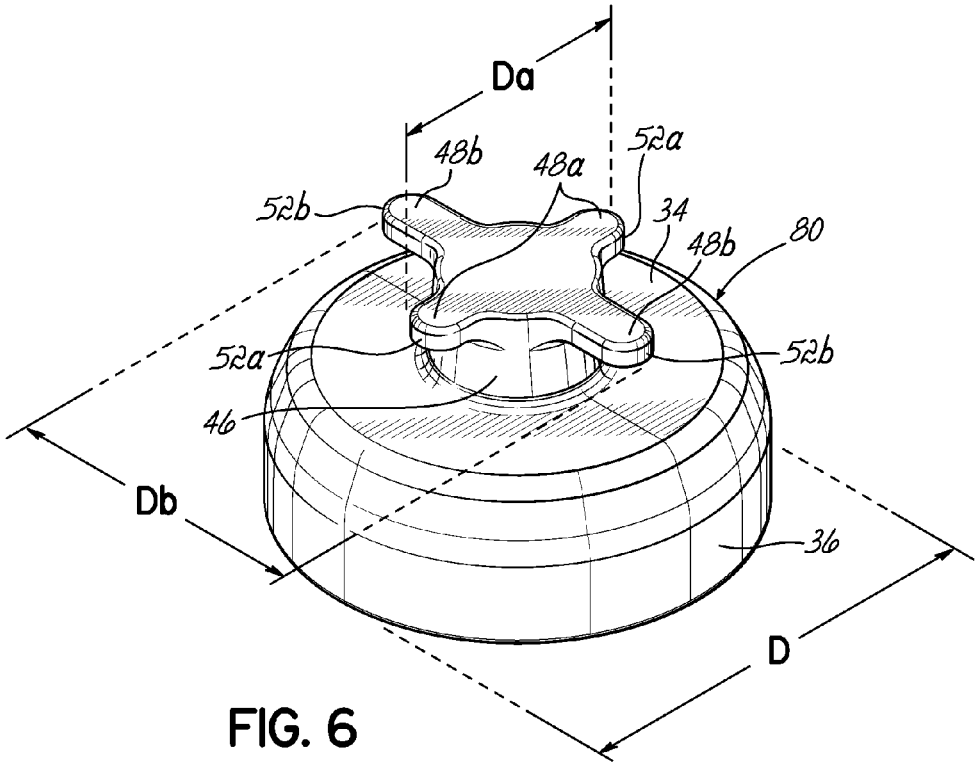
FIG. 6 is a perspective view of a closure for a centrifuge sample container according to another embodiment.
Figure 7:
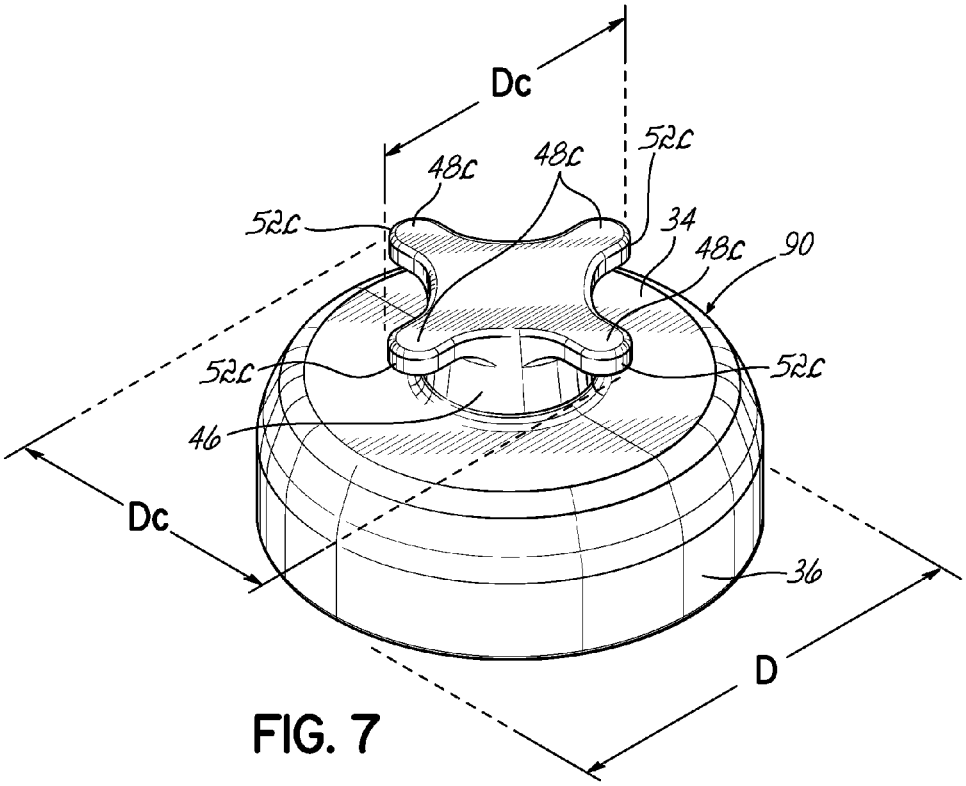
FIG. 7 is a perspective view of a closure for a centrifuge sample container according to yet another embodiment.

Among the contemplated alternative embodiments are closures having four finger grips extending radially outward from a central boss and arranged circumferentially at ninety degree intervals, such as shown in the embodiments of FIGS. 6 and 7, where similar reference numerals indicate similar features as described above.

Referring to FIG. 6, closure 80 includes a pair of diametrically opposed short finger grips 48*a* interspaced by a pair of diametrically opposed long finger grips 48*b*. The short finger grips 48*a* may extend radially outward such that their free terminal ends 52*a* define a maximum outer diameter Da that is less than or equal to approximately 40% of the maximum outer diameter D defined by the annular skirt wall 36. The long finger grips 48*b* may extend radially outward such that their free terminal ends 52*b* define a maximum outer diameter Db that is greater than diameter Da. More specifically, diameter Db may be greater than or equal to approximately 60% of the maximum outer diameter D defined by the annular skirt wall 36, and simultaneously less than or equal to the maximum outer diameter D. The configuration shown in FIG. 6 provides a benefit of allowing a variety of different users, each having hands of a potentially unique size, to selectively grasp either or both pairs of finger grips 48*a*, 48*b*. For example, a user may use two fingers to grasp one of the long finger grips 48*b*, and two fingers of the same hand to simultaneously grasp the other one of the long finger grips 48*b*.

Referring to FIG. 7, in yet another embodiment of the invention, closure 90 includes two pairs of diametrically opposed finger grips 48*c*, where each of the finger grips 48*c* extends radially outward with a common length. As such, the free terminal ends 52*c* of each pair of diametrically opposed finger grips 48*c* define a maximum outer diameter Dc, which is less than or equal to the maximum outer diameter D defined by annular skirt wall 36. For example, diameter Dc may be less than or equal to approximately 40% of the maximum outer diameter D, greater than approximately 40% of and less than approximately 60% of the maximum outer diameter D, or greater than approximately 60% of and less than or equal to the maximum outer diameter D.

Referring back to FIGS. 3 and 4, the closure 14 may further include a sealing plug 60 located in an inner pocket 61 defined by the top wall 34 and the skirt wall 36. The sealing plug 60 is configured to plug the mouth 22 of the container body 12 when the closure 14 is attached to the container body 12. In particular, the sealing plug 60 may include a lower plugging portion 62 that is sized and shaped to be received by the mouth 22 so as to engage a radially inner surface 64 of container body 12. A seal 66, shown in the form of an o-ring, may be used in conjunction with the sealing plug 60 to achieve a liquid-tight seal of the mouth 22 when the closure 14 is threadedly engaged with the container body 12. In particular, as shown, the seal 66 may be positioned between an outer lip 68 of the sealing plug 60 and the rim 28 of the container body 12. When the closure 14 is fully threadedly engaged with the container body 12, the seal 66 is compressed between the sealing plug 60 and the rim 28, thereby forming a liquid-tight seal.

As best shown in FIG. 4, the handle 16 may be hollow so as to define a central recess 70 extending axially into an interior of the central boss 46. The central recess 70 may be sized and shaped to receive a central boss 72 extending axially from a top wall 74 of the sealing plug 60. As shown, the recess 70 and the central boss 72 may each cylindrical and coaxially aligned about the axial centerline of the closure 14.

While the present invention has been illustrated by the description of a specific embodiment thereof, and while the embodiment has been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A closure for attachment to a sample container configured for use in a centrifuge, the closure comprising:

a top wall;

an annular skirt wall depending from the top wall and defining a maximum outer diameter, the annular skirt wall having a threaded inner surface configured to engage a container body; and a handle extending from the top wall and formed integrally with the top wall and the annular skirt wall, the handle including a central boss and at least two circumferentially spaced finger grips extending radially outward from the central boss, wherein the at least two finger grips are axially offset from the top wall of the closure such that an axial space is defined between the top wall of the closure and a respective underside of each of the at least two finger grips at least at respective free terminal ends thereof, the finger grips and axial spaces being configured to enable grasping of the handle to facilitate lifting of the closure and sample container, and further wherein the respective free terminal end of each of the finger grips is located so as not to extend beyond the maximum outer diameter.

2. The closure of claim 1, wherein the central boss extends along an axial centerline of the closure.

3. The closure of claim 2, wherein the central boss includes an upper portion and the at least two finger grips extend radially outward from the upper portion.

4. The closure of claim 1, wherein the handle includes first and second diametrically opposed finger grips.

5. The closure of claim 3, wherein the handle includes first and second diametrically opposed finger grips.

6. The closure of claim 1, wherein the central boss includes a generally circular cross-sectional shape.

7. The closure of claim 1, wherein the closure further comprises a sealing member located in an inner pocket defined by the top wall and the skirt wall of the closure.

8. The closure of claim 7, wherein the handle is hollow and defines a recess, and further wherein the sealing member includes a central boss received in the recess of the handle.

9. A sample container for use in a centrifuge, comprising:

a container body having an inner cavity, a mouth opening to the inner cavity, and a threaded outer surface located below the mouth opening; and a closure removably attachable to the container body for closing the mouth when the closure is attached to the container body, the closure including:

a top wall;

an annular skirt wall depending from the top wall and defining a maximum outer diameter, the annular skirt wall having a threaded inner surface configured to engage the threaded outer surface of the container body; and a handle extending from the top wall and formed integrally with the top wall and the annular skirt wall, the handle including a central boss and at least two circumferentially spaced finger grips extending radially outward from the central boss, wherein the at least two finger grips are axially offset from the top wall of the closure such that an axial space is defined between the top wall of the closure and a respective underside of each of the at least two finger grips at least at respective free terminal ends thereof, the finger grips and axial spaces being configured to enable grasping of the handle to facilitate lifting of the closure and sample container, and further wherein the respective free terminal end of each of the finger grips is located so as not to extend beyond the maximum outer diameter.

10. The sample container of claim 9, wherein the central boss extends along an axial centerline of the closure.

11. The sample container of claim 10, wherein the central boss includes an upper portion and the at least two finger grips extend radially outward from the upper portion.

12. The sample container of claim 9, wherein the handle includes first and second diametrically opposed finger grips.

13. The sample container of claim 9, wherein the closure further includes a sealing element located in an inner pocket defined by the top wall and the skirt wall of the closure.

14. The sample container of claim 13, wherein the handle is hollow and defines a recess, and further wherein the sealing member includes a central boss received in the recess of the handle.

15. The sample container of claim 9, wherein the container body includes a first threaded portion adjacent to the mouth, and the skirt wall of the enclosure includes a second threaded portion configured to threadedly engage the first threaded portion when the closure is attached to the container body and the handle is rotated.

16. The sample container of claim 9, wherein the sample container comprises a centrifuge bottle.

* * * * *